US010434352B2

(12) United States Patent
Campbell

(10) Patent No.: US 10,434,352 B2
(45) Date of Patent: Oct. 8, 2019

(54) LOCOMOTOR TRAINING SYSTEM AND METHODS OF USE

(71) Applicant: Daniel Campbell, Chandler, AZ (US)

(72) Inventor: Daniel Campbell, Chandler, AZ (US)

( * ) Notice: Subject to any disclaimer, the term of this patent is extended or adjusted under 35 U.S.C. 154(b) by 117 days.

(21) Appl. No.: 15/829,418

(22) Filed: Dec. 1, 2017

(65) Prior Publication Data

US 2018/0154202 A1 Jun. 7, 2018

Related U.S. Application Data

(60) Provisional application No. 62/429,328, filed on Dec. 2, 2016.

(51) Int. Cl.

| | |
|---|---|
| ***A63B 21/068*** | (2006.01) |
| ***A63B 21/00*** | (2006.01) |
| ***A61H 3/00*** | (2006.01) |
| ***A63B 23/04*** | (2006.01) |
| ***A63B 21/28*** | (2006.01) |

(52) U.S. Cl.

CPC ..... *A63B 21/00181* (2013.01); *A61H 3/00* (2013.01); *A63B 21/0004* (2013.01); *A63B 21/068* (2013.01); *A63B 21/28* (2013.01); *A63B 21/285* (2013.01); *A63B 21/4011* (2015.10); *A63B 21/4013* (2015.10); *A63B 21/4015* (2015.10); *A63B 21/4035* (2015.10); *A63B 23/0494* (2013.01); *A61H 2003/007* (2013.01); *A61H 2201/0157* (2013.01); *A61H 2201/1253* (2013.01); *A61H 2201/1284* (2013.01); *A61H 2201/1642* (2013.01); *A63B 2225/09* (2013.01)

(58) Field of Classification Search

None

See application file for complete search history.

(56) References Cited

U.S. PATENT DOCUMENTS

| | | | | |
|---|---|---|---|---|
| 2,210,269 | A | 8/1940 | Taylor | |
| 2,966,905 | A * | 1/1961 | Kamenshine | A61H 3/00 482/51 |
| 5,330,417 | A * | 7/1994 | Petersen | A63B 23/0494 482/124 |
| 6,280,365 | B1 * | 8/2001 | Weber | A63B 21/018 482/124 |
| 6,666,831 | B1 | 12/2003 | Edgerton et al. | |
| 6,936,020 | B2 * | 8/2005 | Davis | A61F 5/0125 128/878 |
| 7,297,090 | B2 * | 11/2007 | Torres | A63B 21/015 482/124 |
| 7,931,609 | B2 * | 4/2011 | Blanchard | A61F 5/05841 602/20 |

(Continued)

*Primary Examiner* — Stephen R Crow

(74) *Attorney, Agent, or Firm* — Schmeiser, Olsen & Watts LLP

(57) ABSTRACT

A locomotor training system, including device and methods of use, is provided. The locomotor training device is a simple mechanical device which includes a rigid supporting member coupled to the front-thigh side of a user's proximal lower extremity and a hinged member coupled to the lower extremity distal to the rigid supporting member. Manipulation of the device by an operator, in some cases facilitated by an adjustable handle, facilitates the user's normalization of joint mechanics associated with unimpaired ambulation while providing neuromuscular re-education and muscle strengthening.

20 Claims, 11 Drawing Sheets

(56) References Cited

U.S. PATENT DOCUMENTS

| | | | | |
|---|---|---|---|---|
| 8,251,930 | B2 * | 8/2012 | Ido | A61H 1/0237 601/23 |
| 9,682,104 | B2 | 6/2017 | Patel | |
| 9,731,162 | B2 * | 8/2017 | Martin | A63B 21/4043 |
| 9,737,453 | B2 * | 8/2017 | Shimada | A63B 22/0046 |
| 2016/0008655 | A1 | 1/2016 | Martin | |

* cited by examiner

LOCOMOTOR TRAINING SYSTEM AND METHODS OF USE

CROSS REFERENCE TO RELATED APPLICATION

This application claims priority to U.S. Provisional Patent Application to Daniel Campbell entitled "SYSTEMS AND METHOD FOR A LOCOMOTOR TRAINING DEVICE," application No. 62/429,328, filed Dec. 2, 2016, the disclosures of which are hereby incorporated entirely herein by reference.

BACKGROUND OF THE INVENTION

Technical Field

This invention relates to locomotor training devices and systems. Specifically, embodiments of the invention relate to a locomotor training and assist device and methods of use by persons incapable of unassisted normal ambulation.

State of the Art

Inability to ambulate normally unassisted arises from a variety of causes, including partial or complete paralysis and other neuromuscular conditions affecting the lower extremities. Rehabilitation following spinal cord injury with partial incomplete paralysis of the lower extremities involves rebuilding strength and balance through neuromuscular reeducation techniques. Persons unable to walk independently, but with some lower extremity muscle strength and control (functional ambulation categories 1 & 2), require continuous or intermittent manual contact from another person to assist with ambulation training.

It is optimal that supportive contact may be provided indirectly through the use of an assist device. Such indirect support forces the trainee to use essentially all of their existing strength, balance, and coordination. The trainee, therefore, makes optimal use of available functioning neuromuscular units. The training activity acts to increase the trainee's ability to ambulate normally, as well as their physiological fitness, strength and coordination by stimulating muscular hypertrophy and neuroplasticity, to the greatest possible degree.

Currently available ambulation assist and training devices take many forms, including motorized treadmills coupled to a supportive sling or similar device for partially supporting body weight, other suspension systems, robotic systems, wheeled walker-carriages with supporting frames, resistance devices for training of individual joints such as the knee or ankle, and the like. Neither these nor other currently available devices, however, allow a person with incomplete or complete paralysis of the lower extremities to ambulate across a surface using or not using available neuromuscular function while a second person provides physical assistance to recreate and support weight bearing and joint mechanics similar to fully independent, unimpaired ambulation.

Accordingly, what is needed is a device and method of use for ambulation training and assistance which allows the user, with appropriate external bracing, to support their body weight while re-creating normal joint mechanics for forward ambulation.

SUMMARY OF THE INVENTION

Embodiments of the present invention include a locomotor training and assistance device, including methods of use.

The locomotor training device operates in relation to the ventral surface of the user's lower extremity(ies), allowing an assistant ("operator"), such as a physical therapist, caregiver, or family member, to "fill-in" movement of the user's impaired lower extremity in a manner which recreates normal joint mechanics, within the user's existing physical or anatomic limitations. The user is able to walk in a forward direction, and to turn, while supporting their bodyweight. The operator is positioned in front of the user, rather than alongside or behind, while not directly contacting the user and impeding forward ambulation.

Disclosed is a locomotor training device comprising a rigid bracing member having a first user end coupled to a first ventral leg attachment and an operator end coupled to a handle; a hinged bracing member coupled to the rigid bracing member at a first joint near the operator end, having a first segment coupled to the first joint, a second segment rotatably coupled to the first segment opposite a second user end; and a second ventral leg attachment coupled to the second user end.

In some embodiments, the first joint comprises an adjustable couple that slideably engages the rigid bracing member and is rotatably coupled to the first segment, having a slide locking means configured to reversibly lock the adjustable couple in a position along a continuum of positions relative to the operator end of the rigid bracing member.

In some embodiments, the locomotor training device further comprises a foot position biasing system having a shoe sleeve configured to removably attach to a shoe; an offset member coupled to the second segment; and a biasing member coupled between the shoe sleeve and the offset member; wherein the offset member is configured to position the biasing member to bias the shoe worn by a user into an ambulatory position. In some embodiments, the biasing member reversibly couples to the shoe sleeve at an attachment point selected from a plurality of attachment points. In some embodiments, the locomotor training device comprises a number of offset members and a corresponding number of biasing members.

In some embodiments, the ambulatory position is either eversion or inversion. In some embodiments, the ambulatory position is either internal rotation or external rotation. In some embodiments, the shoe is biased into a plurality of ambulatory positions.

Disclosed is a locomotor training device comprising a rigid bracing member having a first user end and an operator end, wherein the rigid bracing member is configured to form a first angle with a ventral surface of a lower extremity of a user when the first user end is pivotally coupled to the lower extremity; and a hinged bracing member coupled to the rigid bracing member at a first joint located near the operator end, having a first segment pivotally coupled to the first joint, a second segment pivotally coupled to the first segment at a second joint and having a second user end; wherein under a condition of the first user end pivotally coupled to the ventral surface of the lower extremity and the second user end pivotally coupled to the ventral surface of lower extremity distal to the first user end, pivoting the first user end at the lower extremity to decrease the first angle causes the hinge to open; and pivoting the first user end at the lower extremity to increase the first angle causes the hinge to close.

In some embodiments, the first joint is configured to form a second angle between the rigid bracing member and the first segment within a range of about 30° to about 150°. In some embodiments, the hinged member is configured to form a third angle between the first segment and the second segment within a range of about 45° to about 170°.

In some embodiments, the locomotor training device further comprises a first ventral leg attachment coupled to the user end, wherein the first ventral leg attachment is configured to pivotally couple the first user end to the lower extremity.

In some embodiments, the first user end is configured to couple to the lower extremity at a position proximal to a knee of the user. In some embodiments, the first user end is configured to couple to the lower extremity at a position distal to a knee of the user.

In some embodiments, the locomotor training device further comprises a second leg attachment coupled to the second user end of the second segment, wherein the second leg attachment is configured to pivotally couple the second user end to the lower extremity distal to the knee of the user. In some embodiments, the second leg attachment comprises a ventral contacting member, a positioning strap removably coupled to the ventral contacting member; a friction pad coupled to the ventral contacting member; and an adjustable coupling member removably coupled to the ventral contacting member. In some embodiments, the locomotor training device further comprises a first leg attachment coupled to the first user end of the rigid member, wherein the first leg attachment is configured to pivotally couple the first user end to the lower extremity proximal to the second leg attachment.

Disclosed is a method of ambulation training comprising steps coupling a rigid member of a locomotor training device to a ventral surface of a first lower extremity of a user at a first attachment point of the first lower extremity, and a hinged member at a second attachment point distal to a knee of the first lower extremity; shifting a user's weight from the first lower extremity; applying a force to a handle of the locomotor training device forward in a direction of ambulation to cause a foot of the first lower extremity to unweight from an ambulatory surface while simultaneously causing the knee to simultaneously flex and move forward; raising the handle upward from the ambulatory surface, causing the knee to extend and the second attachment point to move further forward; lowering the handle downward toward the ambulatory surface, causing the foot to re-weight onto the ambulatory surface; and shifting the user's weight forward onto the first lower extremity.

In some embodiments, the method further comprises a second coupling step wherein a second locomotor training device is coupled to a second lower extremity of the user; and an additional shifting step, an additional applying step, an additional raising step, an additional lowering step, and an additional shifting step applied to the second lower extremity performed in sequence following the steps of claim 9, causing the user to move forward in the direction of ambulation. In some embodiments, the method further comprises a biasing step, wherein a foot position biasing system coupled to the locomotor training device biases the foot into an ambulatory position.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
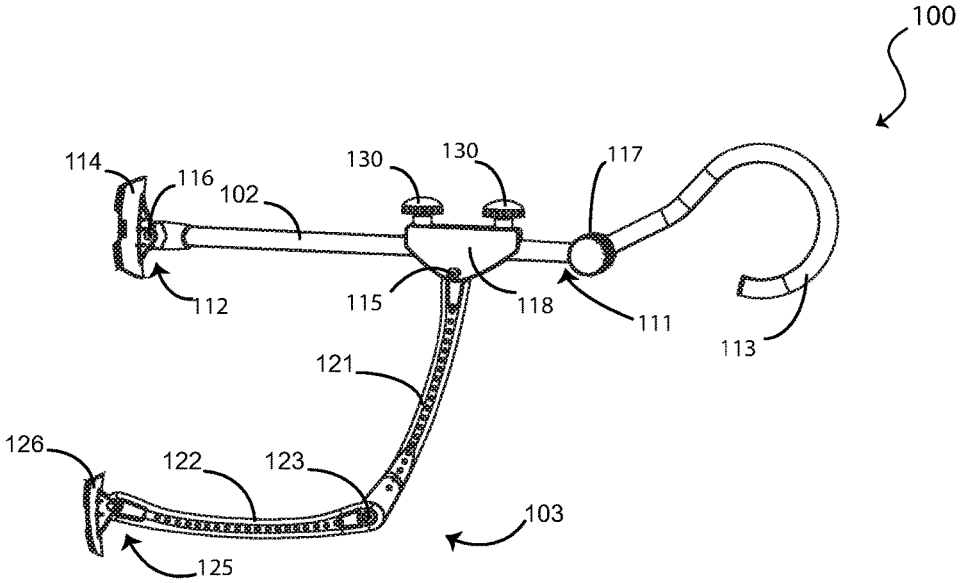
FIG. 1 is a left-side view of a locomotor training device.

Conventional locomotor training systems employ elements to 1) partially or fully suspend a user's body weight; and 2) brace the user's lower extremity from the flexor (dorsal) surface of the impaired joint or extremity. These conventional bracing systems generally employ two bracing members that couple to the user's leg in two separate locations, either with at least two rigid members or at least two flexible (hinged) members. The conventional systems, however, have no mechanism providing for an operator to dynamically position and move the impaired lower extremity to complement the user's intrinsic efforts and to most closely recreate normal ambulatory motion of the lower extremity joints, particularly, the knee and hip joints while maintaining alignment to allow weight bearing without joint injury. Additionally, many of the currently available systems and devices for ambulation training incorporate motorized treadmills which, inherently, do not allow for actual forward ambulation, only leg movements and transitional weight bearing which mimic ambulation.

The foregoing application describes a device and methods of use for a locomotor training system and device. Depending on a user's intrinsic neuromuscular capabilities, the locomotor training device provides a means for the user to walk across a reasonably flat, level surface, step up or down stairs, and the like. The locomotor training device does so through operation of a rigid bracing member and a hinged bracing member coupled at a joint at a distance opposite points of attachment on the user's impaired lower extremity. Coupling the rigid member at a location on the user's impaired extremity proximal to the hinged member allows a single operator to simultaneously 1) support the user's extremity proximally; 2) prevent hyperextension of the user's knee joint; and 3) dynamically off-weight the foot while flexing/extending the user's knee, as needed. This arrangement allows the operator, by grasping a prominent and ergonomic handle coupled to the rigid member opposite the user's lower extremity, to augment or supplant entirely existing muscle strength and replace movements, such as knee flexion, normally performed by innervated and otherwise undamaged neuromuscular units. Moreover, attachment of two locomotor training devices—one to each leg of the user—allows a single operator grasping the ergonomic handle of one device in each hand, to move both of the user's legs, as needed.

As used herein, the following terms have the foregoing meanings, unless explicitly defined otherwise in this specification. "User" means a person with impaired ambulation who receives ambulation assistance and training through use of the locomotor training device. "Operator" means a person who operates the locomotor training device to aid to assist the user with ambulation and ambulation training. The operator manipulates the locomotor training device using arm movements by holding a handle generally disposed on the device opposite points whereupon the device is attached to the user's lower extremity while the device is in use. Various anatomic structure, anatomic position, and anatomic relational terms, including but not limited to lower extremity, thigh, leg, hip, knee, ankle, foot, proximal, distal, dorsal or dorsum, ventral or plantar, dorsiflexion, eversion, inversion, internal rotation, and external rotation have the same meanings herein as when any of these terms is used to describe anatomic structures, positions, and relationships in the context of healthcare delivery, medical device, prosthetics, and biomedical research arts, and the like. As used herein, "lower extremity" means the entirety of the appendage extending distally from the anatomic level of the hip joint to the toes, and "leg" is restricted to mean the segment of the lower extremity located distal to the knee and proximal to the foot. It should also be noted that the meaning of a relational term, such as "dorsal," depends upon the anatomic structure being describe. For example, the dorsal surfaces of the foot and ankle are contiguous with and "face" the same general direction as the ventral surfaces of the leg and thigh; similarly, the ventral or plantar surface of the foot is contiguous with and faces the same general direction as the dorsal surface of the leg and thigh. "Joint" means a structure wherein two engaging parts move with respect to one another while remaining engaged. "Joint" may refer to either a mechanical structure, such as a hinge or pivot joint, or an anatomic structure, such as a knee or a hip, depending on the context wherein the term is used. Unless explicitly stated herein, "joint" is in no way limited to any particular or specific type of joint, whether anatomic or mechanical. "Forward" means in the direction of travel or ambulation. "Flexion" means decreasing the inside angle of a joint, whether the joint is comprised by a mechanical or anatomic structure. Conversely, "extension" means increasing the inside angle of a joint.

FIG. 1 is a left-side view of a locomotor training device. FIG. 1 shows a locomotor training device 100. Locomotor training device 100 is used for multiple applications, depending on the neuromuscular status and goals of the user, including but not limited to assisted ambulation, ambulation strength training, balance training, and neuromuscular reeducation following injury or disease. A user couples locomotor training device 100 to her lower extremity at two locations a first/proximal location and a second distal location. In some embodiments employing a shoe sleeve as part of a foot biasing system, locomotor training device 100 couples to the user's lower extremity at three locations. This will be discussed in more detail herein below. In some embodiments, the first/proximal location is proximal to the knee and the second/distal location is distal to the knee, although this is not meant to be limiting. In some embodiments, both the first/proximal location and the second/distal location are both distal to the knee. Regardless, the first/proximal location is always proximal on the user's lower extremity to the second/distal location.

Locomotor training device 100 comprises a rigid bracing member 102 and a hinged bracing member 103 coupled and movably engaging with one another at a first joint 115. Coupling a rigid member to a hinged member of any locomotor training device is necessary to provide 1) proximal support and fixation of the user's impaired lower extremity; while 2) limiting restriction of volitional distal motion of the user's leg and foot. Accordingly, the user, in some embodiments, may initiate movement of the lower extremity segment coupled to hinged bracing member 103, such as by flexing or extending the knee, while the operator supports or fixes the lower extremity segment coupled to the rigid bracing member, such as the thigh. Means for coupling rigid bracing member 102 and hinged bracing member 103 to a user's lower extremity and methods for using of locomotor training device 100 to assist ambulation, deliver locomotor training, and promote neuromuscular reeducation of a user having neuromuscular impairment of one or both lower extremities are discussed in detail herein below.

In the several embodiments of the invention, rigid bracing member is a generally elongate body having an operator end 111 and a first user end 112, as shown by FIG. 1. Operator end 111 is manipulated by an operator and first user end 112 couples to the user's impaired lower extremity. The operator manipulates operator end 111 by grasping a handle 113 coupled to operator end 111, in some embodiments. Handle 113 comprises a closed shape, such as a circular ring, a "D" ring, or the like, in some embodiments. In some embodiments, handle 113 comprises a "cane handle" shape, such as the embodiment shown in FIG. 1. In some embodiments, handle 113 comprises a feature of user end 111, such as an increased diameter, a high-friction textured surface, a grip-surface molded to accommodate fingers of the operator's hand, or the like. A relatively large, open shape—such as a "cane-shape"—formed in a diameter and cross-sectional profile which is compatible with the user's comfort and ability to securely manipulate operator end 111. In some embodiments, handle 113 is fixedly and immovably coupled to operator end 111; for example, by fixedly engaging with operator end 111, by a mechanical fastener like a bolt, rivet, or screw; by adhering with a glue or other adhesive compound, or by a heat-coupling technique such as welding or annealing.

Alternatively, such as in the embodiments shown in FIG. 1 and some other embodiments, handle 113 is coupled to operator end 111 at an adjustable, releasable joint 117. In this and some other embodiments wherein adjustable joint 117 may be released, the position of handle 113 is adjusted into a desired orientation relative to operator end 111, followed by locking of adjustable joint 117 to maintain the desired orientation. Adjusting the angle of adjustable joint 117, the length that handle 113 extends from operator end 111 at joint 117 or both the angle and length allows greater flexibility for the operator assisting the user of locomotor training device 100 to grasp handle 113 at a position, meaning a length and angle, most ergonomically compatible with the user's height, arm length, etc. relative to the anthropometrics of the user.

In some embodiments, the position is an angle of orientation between handle 113 and operator end 111 at joint 117. In some embodiments, the position is a linear extension of handle 113 with respect to operator end 111 at joint 117. In some embodiments, the position is a combination of an angle of the angle of orientation and the linear position. In some embodiments, adjustable joint 117 is reversibly locked into one of a plurality of discontinuous positions with a discreet angle of orientation. In some embodiments, adjustable joint 117 is locked into an angle of orientation along a continuous range of angles of orientation. Similarly, in some embodiments, adjustable joint 117 may be locked into a discreet indexed linear position or at a point along a continuum of linear positions with respect to operator end 111 at joint 117. A variety of locking means known in the mechanical arts may be used in embodiments of joint 117, such as a screw-actuated friction coupling, members bearing engaging complimentary shapes, and others.

FIG. 1 additionally shows hinged bracing member 103 comprising a first segment 121 and a second segment 122 movably coupled at a second joint 123. First segment 121 and second segment 122 are generally elongate, substantially rigid bodies which, in some embodiments, are similar to and formed from the same material as rigid bracing member 102.

Second joint 123, in some embodiments, is a hinge joint or similar joint allowing movement in one plane, although this is not meant to be limiting. Although it is anticipated that the majority of users of locomotor training device 100 will most benefit from movement of second joint 123 within one plane, it is nonetheless possible for certain users to require multi-planar motion of second joint 123. The user may have anatomic deformities of the knee, the hip, or both the knee and the hip which require freedom to adjust second joint 123, first joint 115, or both second joint 123 and first joint 115 in greater than one plane, thus allowing volitional movement at the user's knee while providing support or immobilization of the user's thigh. In such, and in some other embodiments, second joint 115 is formed from a ball-and-socket or similar joint with greater than one degree of freedom for the plane of motion. In some embodiments, second joint 123 may reversibly lock into a position permitting one degree of freedom (mono-planar) volitional motion. In some embodiments, second joint 123 is adjustable on a continuum of positions, wherein the plane of motion of second joint 123 relative to the plane of motion of first joint 115 is adjusted and then reversibly fixed. In some embodiments, the relative position of second joint 114 is not fixed, but moves in response to motion of the user and manipulation of operator end 111 by the operator. Similarly, and in some embodiments, first joint 115 is a ball-and-socket or similar joint with greater than one degree of freedom for the plane of motion, wherein first joint 115 is adjustable, may be reversibly fixed, and allows a continuum of positions for the plane of motion of first joint 115.

It is important, for many users, to limit the range of motion of first segment 121 with respect to second segment 122. Limitation of this range of motion helps prevent hyperextension of the user's knee joint, and allows increased control in moving the user's leg, ankle, and foot by the operator. In some embodiments, joint 123 is limited to a position between about forty-five degrees (45°) and about one hundred seventy degrees (170°). This range facilitates lifting of the user's foot by the operator, safe assistance of flexion and extension of the user's knee joint by the operator, and re-planting the user's foot firmly on the walking surface by the operator to allow the user to on-weight the planted lower extremity without hyperextension of the user's knee. Limitation of the planar range of motion of second joint 123, in some embodiments, is accomplished by a pin or the like internal within second joint 123 coupled to or unitary with either first segment 121 or second segment 122 which engages with a complementary internal feature, such as a curved groove with two ends, or the like, unitary with corresponding second segment 122 or first segment 121. Other joints comprising features which limit mono-planar motion within an angular range known in the mechanical arts are also employed to coupled first segment 121 and second segment 122 at second joint 123, in some embodiments.

FIG. 1 additionally shows first ventral leg attachment 114 coupled to first user end 112 of rigid bracing member 102 at a third joint 116. Similarly, a leg attachment 126 is shown coupled to second user end 125 of second segment 122. First ventral leg attachment 114 is configured to couple rigid bracing member 102 to a ventral aspect of the user's lower extremity, such as the user's ventral thigh area. Third joint 116 is designated for detailed discussion of methods of use in association with FIGS. 8-10*d* herein.

Attachment 114, in some embodiments, comprises a first rigid plate 127 (See FIG. 5) coupled to a pad, a positioning strap, and a securing strap, in some embodiments. Rigid plate 127 moveably couples to first user end 112. In some embodiments, the movable couple is a pivot joint which moves in one plane. In some embodiments, the moveable couple is a multi-planar joint, such as a ball-and-socket joint, for example. In some embodiments, the moveable couple comprises a clevis pin, bolt, or other readily removeable fastener. It is advantageous wherein first ventral leg attachment 114 is easily removed from rigid bracing member 102 at third joint 116 because this allows the use of a plurality of sizes of the rigid plates according to the size of the lower extremity of the user, or the position on the ventral aspect of the lower extremity that is coupled to first ventral leg attachment. In some embodiments, the pad is fixedly or removeable coupled to a concave surface of the rigid plate and comprises a bacteriostatic coating or material to minimize microbial growth on the pad surface following extended use. In some embodiments, the pad is a friction pad, wherein friction between the pad and the ventral surface of the user's lower extremity resists slippage or position changes of attachment 114 relative to the lower extremity. In some embodiments, leg attachment 125 comprises similar elements as first ventral leg attachment 114. First ventral leg attachment 114 and leg attachment 126 are discussed in detail herein below in association with FIGS. 5-6.

Figure 2:
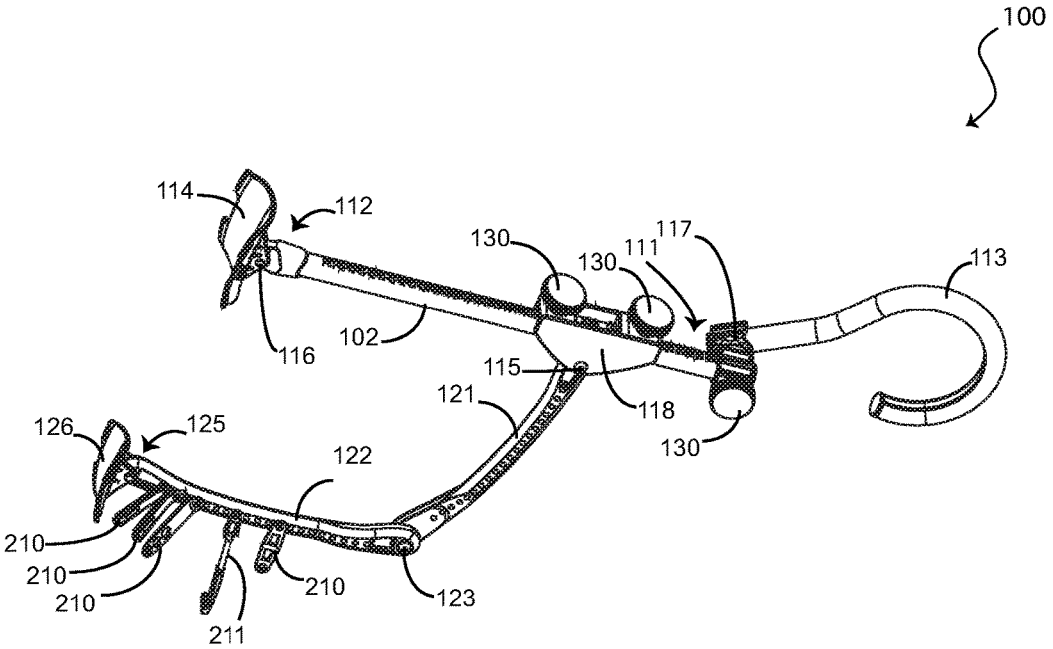
FIG. 2 is a perspective view of a locomotor training device.

FIG. 2 is a perspective view of a locomotor training device. FIG. 2 shows device 100, including adjustable joint 117. Adjustable joint 117, in some embodiments, adjustably couples handle 113 to rigid bracing member 102. In some embodiments, including the embodiments shown in the several drawing figures, adjustable joint 117 allows incremental adjustment of an angle formed between handle 113 and rigid bracing member 102. In some embodiments, adjustable joint 117 allows adjustment along a continuum of angles. In some embodiments, including the embodiment shown in FIG. 2, adjustable joint 117 allows adjustment along a continuum of lengths comprising overlap between rigid bracing member 102 and handle 113 at joint 117. As already mentioned, embodiments comprising adjustable joint 117 increase ease of use of locomotor training device 100 for operators and users of different heights and extremity lengths.

FIG. 2 also shows some elements of a foot position biasing system 200. Foot position biasing system 200 is configured to bias the user's foot in an anatomic position to allow for safe ambulation. Forces necessary to bias the foot into this anatomic position will be particular to the specific user's constellation of neuromuscular characteristics. For example, a user with "foot drop" arising from limited function of the tibialis anterior muscle or a nonfunctioning $5^{th}$ lumbar dorsal nerve root will require biasing of the impaired foot into dorsiflexion. Other examples of foot-biasing forces to facilitate safe ambulation assistance and training include eversion, inversion, internal rotation, and external rotation. A foot-biasing force may be desired in one direction, two directions, or any number of directions, depending upon any neuromuscular paralysis or impairment acting on the user's knee, ankle, or hip joints, or at a combination of joints. A non-limiting example of elements of foot position biasing system 200 is also shown herein by FIG. 7*a*.

Embodiments of locomotor training device 100 comprising foot position biasing system 200 may allow of optimal positioning of the user's foot though a plurality of biasing elements, which are discussed in more detail herein below. An offset member 210 is shown in FIG. 2. Offset member 210 couples a biasing member 211 to second segment 122 of hinged bracing member 103. Biasing member 210 is, in some embodiments, an elastomeric member which delivers a magnitude of a biasing force to the user's foot. The direction of the biasing force is determined by the shape of offset member 210 and the point at which offset member 210 is coupled to both second segment 122 and a shoe 201 or shoe sleeve 202 (elements not shown in FIG. 2; see, rather, FIGS. 6-8 and discussed herein below). Offset member 210 is formed to offset biasing member 211 at an angle from second segment 122. This can be seen in several of the plurality of offset members 210 shown in FIG. 2. Additionally, in some embodiments, offset member 210 is reversibly coupled to a position on second segment 122 by a coupling element, such as a clevis pin, clip, other removable fastener, or the like.

Figure 3:
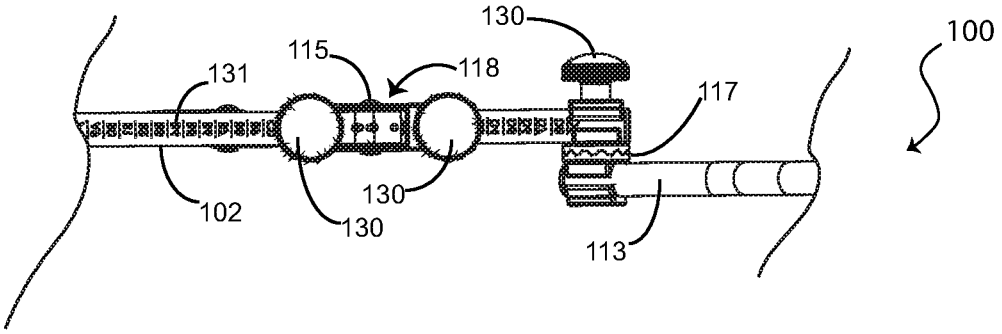
FIG. 3 is an enlarged partial top view of a slide couple of a locomotor training device.
Figure 4:
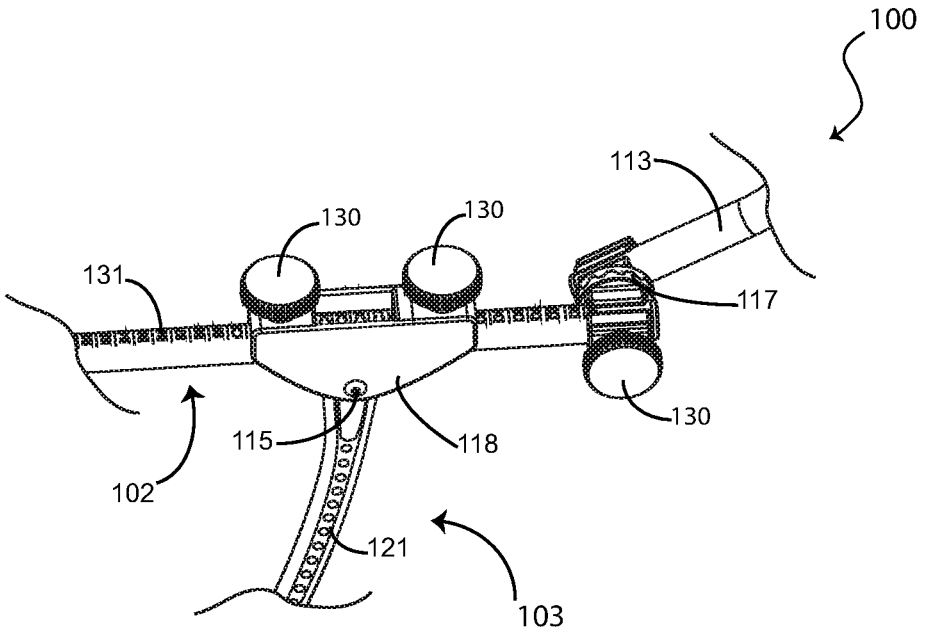
FIG. 4 is an enlarged partial perspective view of a slide couple of a locomotor training device.

FIG. 3 is an enlarged partial top view of a slide couple of a locomotor training device. FIG. 4 is an enlarged partial perspective view of a slide couple of a locomotor training device. In some embodiments, first joint 115 of locomotor training device 100 is carried by a slide couple 118. Slide couple 118 is configured to adjustably move first joint 115 to any of a plurality of locations along rigid bracing member 102 relative to operator end 111. In some embodiments, the plurality of locations are on a continuum. In some embodiments, the plurality of locations are discreet locations. The user or operator wishing to change the position of first joint 115 with respect to operator end 111, or, conversely, first user end 112, may loosen a coupling of an engagement feature to allow movement of slide couple 118 with respect to operator end 111, moves slide couple 118 into a desired position along rigid bracing member 102, and then tightens the coupling of the engagement feature. In some embodiments, including but not limited to the embodiment shown in FIGS. 2-4, the engagement feature is a tension knob 130. Threads coupled to tension knob 130 (not shown) are received within an opening (not shown) of slide couple 118 to engage with a complimentary threaded surface within slide couple 118. Tightening of tension knob 130 engages an end of tension knob 130 with a surface of rigid bracing member 102. In some embodiments, the surface comprises a position index 131. Position index 131 is a set of markings which the user or operator may line-up with a window, marking, or other feature of slide couple 118 to temporarily but reproducibly position slide couple 118 along the length of rigid bracing member 102.

As shown by FIG. 4, the user or operator of locomotor training device 100, in some embodiments comprising slide couple 118 and adjustable joint 117, can adjust the position of slide couple 118 on rigid bracing member 102. This configuration allows adjustment and positioning of first joint 115 to increase or decrease the angle of second joint 123 under a condition wherein rigid bracing member is parallel with the floor or other ambulation surface. Adjustment of the angle formed by second joint 123 at a given position of rigid bracing member 102 increases the versatility of locomotor training device to most advantageously position second user end 125 with respect to first user end 112 throughout a plurality of operator and user heights and other anthropometrics and a range of user anatomy and neuromuscular capabilities. The utility of adjusting the position of first joint 115 to change the angle at second joint 123 is discussed in further detail in association with FIGS. 8-10*d* herein.

The configuration of tension knob 130, position index 131, and rigid bracing member 102 as described respectively is not meant to be limiting. Any configuration that includes a position index and a tension knob 130 configured to releasably and reproducibly fix slide couple 118 in a set position along rigid bracing member 102 is found in embodiments of device 100 comprising slide couple 118.

Figure 5:
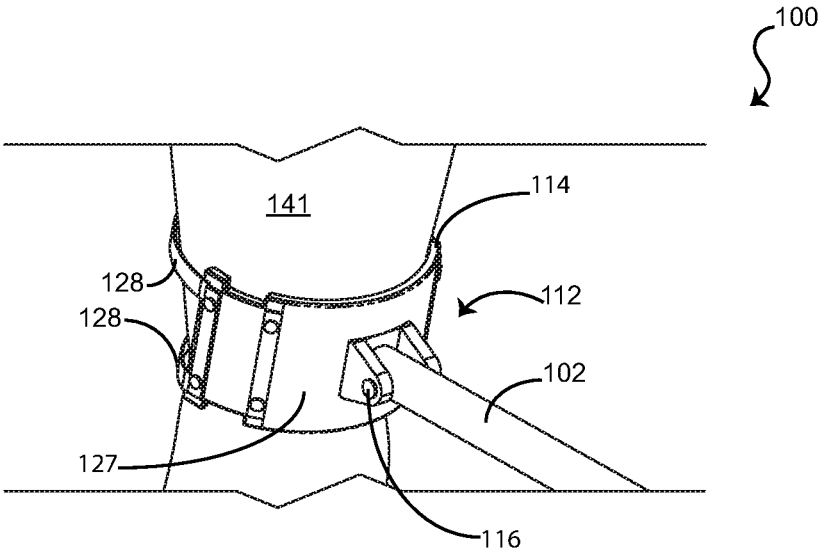
FIG. 5 is a perspective view of a first ventral leg attachment coupled to a lower extremity of a user.

FIG. 5 is a perspective view of a first ventral leg attachment coupled to a lower extremity of a user. FIG. 5 shows rigid member 102 coupled to ventral leg attachment 114 at third joint 116. In some embodiments, including the embodiments shown by FIG. 5, third joint 116 is a mono-planar hinge pivot joint. As previously mentioned, this is not meant to be limiting. A rigid plate 127 is secured to a ventral surface of the user's lower extremity by a first strap 128. In some embodiments, two or more first straps 128 are configured to secure rigid plate 127 to the user's lower extremity. First strap 128 comprises a reversible securing means, such as hook-and-loop fasteners, threading and back-threading through a rigid ring-loop, snaps or similar fasteners, clips, or the like to removably and adjustably couple rigid plate 127 of first ventral leg attachment 114 to the user's lower extremity. In the embodiments shown in FIG. 5, and in some other embodiments, first ventral leg attachment 114 couples to a thigh 141 of the user. Although a ventral surface of thigh 141, proximal to the knee joint, is most frequently the best anatomic location for coupling first ventral leg attachment 114 to the user, this is not meant to be limiting. For some users, coupling first ventral leg attachment 114 to a ventral surface of the user's lower extremity distal to the knee, such as the pretibial surface of the leg, for example, provides greater functionality for the user. The best location along the ventral surface of the lower extremity for coupling first ventral leg attachment 114 to a ventral surface of the lower extremity depends on the anatomy and functional capabilities of the particular user, and will vary between individual users. In some embodiments, a positioning strap (not shown) releasably couples to rigid plate 127 in two locations, passing around the dorsal aspect of the user's lower extremity to hold rigid plate 127 against the ventral surface of thigh 141 to resist slippage or movement while the user or operator secures and adjusts one or more first straps 128 between first ventral leg attachment 114 and thigh 141. In some embodiments, a pad (not shown) is coupled to the concave surface of rigid plate 127 to engage with the ventral surface of thigh 141. The pad provides a more comfortable interface between rigid plate 127 and thigh 141. As discussed herein, the pad may comprise a bacteriostatic or similar antimicrobial coating or treatment to mitigate colonization of the pad with bacteria, along with an attendant odor and increased risk of skin infections. The pad, additionally, increases friction between rigid plate 127 and the ventral surface of thigh 141, to resist shifting of the position of rigid plate 127 and thigh 141.

Figure 6:
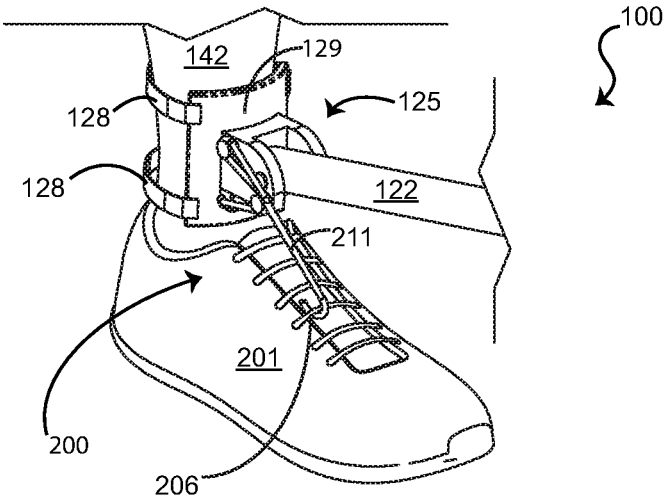
FIG. 6 is a perspective view of a second ventral leg attachment fitted with a foot position biasing system coupled to a lower extremity of a user.

FIG. 6 is a perspective view of a second ventral leg attachment fitted with a foot position biasing system coupled to a lower extremity of a user. FIG. 6 shows second user end 125 of second segment 122 of hinged bracing member 103 coupled to leg attachment 126. In this and some other embodiments, leg attachment 126 is coupled just proximal to the ankle of the user. Although often advantageous, other positions for coupling along the user's leg are possible, and the configuration shown by FIG. 6 is not meant to be limiting. Similar to first ventral leg attachment 114, in some embodiments, leg attachment 126 may comprise some or all of the elements including a second rigid plate 129 which may be coupled to a pad at a concave surface, a pad with properties such as an antimicrobial element or an antifriction element, one or more first straps 128, and the positioning strap, in any combination. Many configurations of first strap(s) 128 and leg attachment 126 are possible to secure second user end 125 to the ventral surface of the user's leg distal on the user's leg with respect to the attachment of first user end 112, as already discussed.

FIG. 6 additionally shows elements of foot position biasing system 200. Biasing member 211, in the embodiment shown and in some other embodiments, couples to an attachment point 206 of a shoe 201 worn by the user of locomotor training device 100. Attachment point 206 is shown as a shoelace, however this is not meant to be limiting. Additional forms and configurations of attachment points 206 are discussed in detail at length herein below. FIG. 6 shows biasing member 211 coupled to a surface feature (undesignated) of second user end 125 of second segment 122. No offset member 210 is used in the embodiment shown, and in some other embodiments. As will be appreciated upon consideration of FIG. 6, this positioning of biasing member 211 tends to bias shoe 201 worn by the user 1) primarily into dorsiflexion; and 2) secondarily into eversion.

Figure 7A:
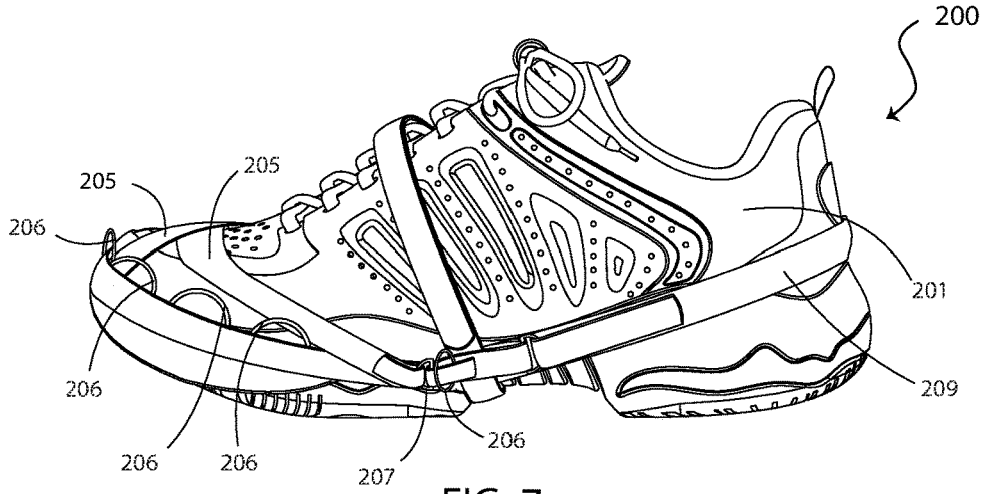
FIG. 7*a* is a perspective view of a shoe sleeve for a foot position biasing system fitted over a shoe.
Figure 7B:
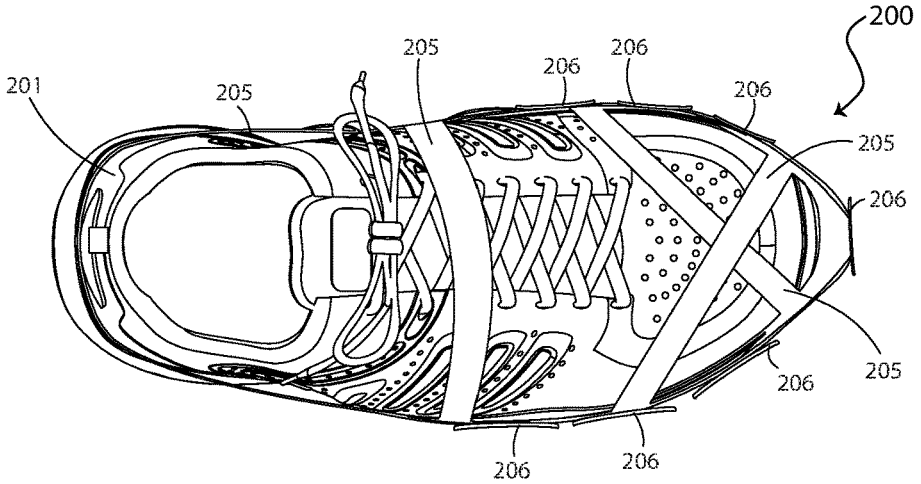
FIG. 7*b* is a top view of a shoe sleeve for a foot position biasing system fitted over a shoe.
Figure 7C:
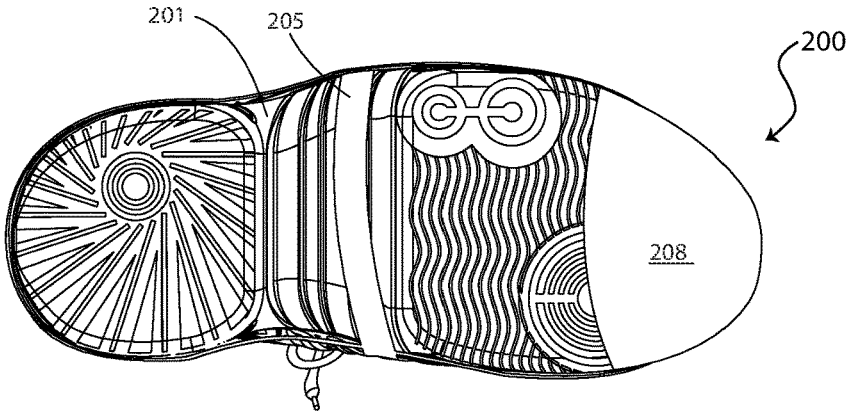
FIG. 7*c* is a bottom view of a shoe sleeve for a foot position biasing system fitted over a forefoot of a shoe.
Figure 8:
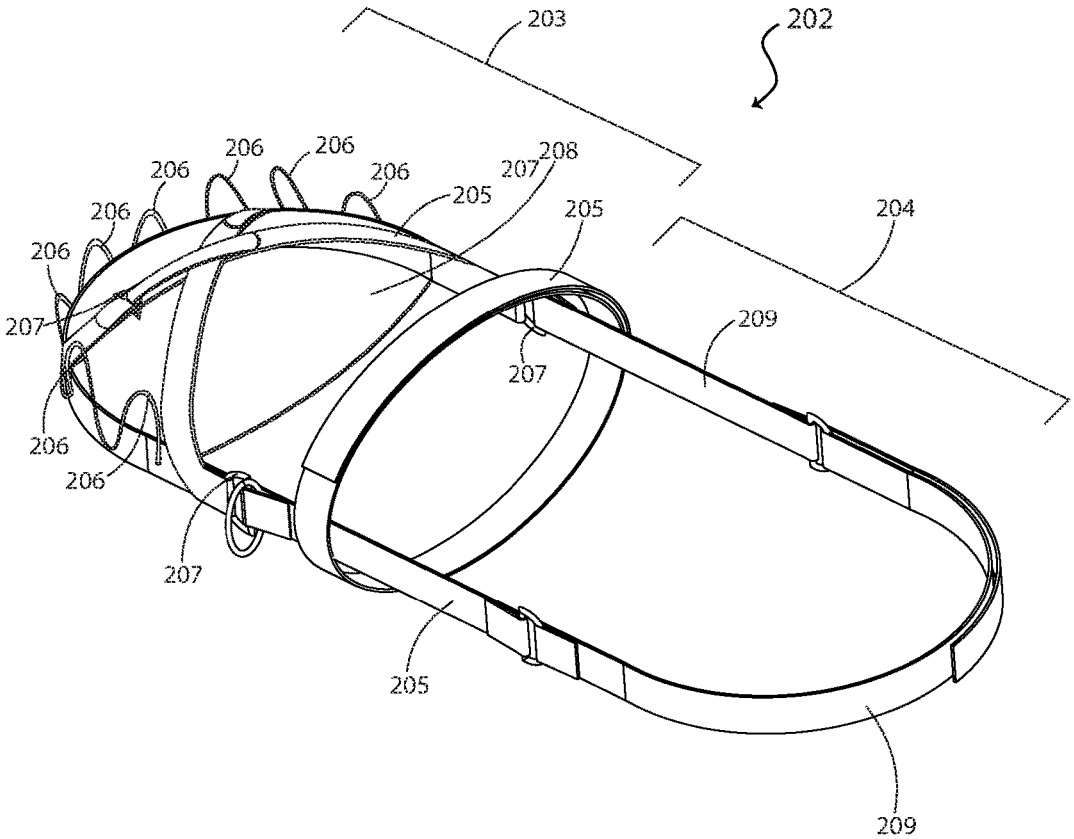
FIG. 8 is a top view of a shoe sleeve for a foot position biasing system.

FIGS. 7*a-d* are views of a shoe sleeve for a foot position biasing system fitted over a user's shoe. FIG. 7*a* is a perspective view of a shoe sleeve for a foot position biasing system fitted over a shoe. FIG. 7*b* is a top view of a shoe sleeve for a foot position biasing system fitted over a shoe. FIG. 7*c* is a bottom view of a shoe sleeve for a foot position biasing system fitted over a forefoot of a shoe. FIG. 8 is a top view of a shoe sleeve for a foot position biasing system.

FIGS. 7*a-c* show a shoe sleeve 202 comprising a fitting strap 205, an attachment point 206, and a D-ring 207. Shoe sleeve 202, in some embodiments, comprises two separate sections—a toe piece 203 and a heel piece 204 (shown by FIG. 8). Toe piece 203 fits over the toe and forefoot-section of shoe 201 and comprises a forefoot friction pad 208 (shown in FIG. 7*c*). Forefoot friction pad 208 is configured to decrease adhesion between shoe sleeve 202 and the floor or other ambulation surface when the user off-weights the lower extremity coupled to ambulation training device 100. This friction reduction between forefoot friction pad 208 and the ambulation surface minimizes the effort required to overcome the resistance resulting from friction between the user's shoe sole and the ambulation surface as the user attempts to "toe-off" of the ambulation surface. In certain users of system and device 100, proprioception may be impaired and the user may not sense when or if the foot is clearing the ambulation surface.

Heel piece 204, in some embodiments, fits over the heel/hindfoot portion of shoe 201. Heel piece 204 and toe piece 203 are then removeably coupled together, in some embodiments, by a coupling means. One example of a coupling means is shown in FIGS. 7-8 and comprises D-ring 207 coupled to toe piece 203 in two locations, one D-ring 207 medially and a second D-ring 207 laterally. A heel strap 209 coupled to heel piece 204 passes forward through D-ring 207 and then backward overlapping itself. D-ring 207 is then reversibly coupled to itself using hook-and-loop fasteners, clips, or the like. Other suitable coupling means may be used in some embodiments. In some embodiments, heel piece 204 comprises two heel straps 209. In some embodiments, heel piece 204 comprises one heel strap 209 which is adjustable in length. Other adjustable configurations of heel strap 209 are used, in some embodiments. In some embodiments, heel piece 204 additionally comprises a heel strap 209 for securing shoe sleeve 202 to the heel of shoe 201, as shown in FIGS. 7-8.

An example method of donning shoe sleeve 202 is provided, for use with some embodiments of foot position biasing system 200. This is offered only as an example to illustrate the process of donning and fitting shoe sleeve 202 onto shoe 201, worn or to be worn by the user. The forthcoming description is in no way meant to be limiting. To don shoe sleeve 202 on shoe 201, loosen all fitting straps 205 and slide shoe sleeve 202 over the toe section of shoe, until toe piece 204 rests snugly over the toe of shoe 201. Adjust, tighten, and secure fitting straps 205 over the distal forefoot-section of shoe 201, then crisscross, snug and secure 2 fitting straps 205 over the more proximal forefoot, near the area where shoelaces are tied. Loosen heel strap 209 and pass heel strap 209 over the heel of shoe 201. Snug and secure heel strap 209. Shoe sleeve 202 is now secured to shoe 201.

FIGS. 7-8 additionally show multiple attachment points 206. Attachment point 206 is shown coupled to toe piece 203, although, in some embodiments, attachment point 206 is coupled to heel piece 204, depending on the biasing force direction desired. A plurality of attachment points 206 disposed along a perimeter of shoe sleeve 202 provides a selection of leverage points upon which to apply a leveraging force exerted by biasing member 211 coupled to offset member 210. To bias the user's foot into a desired position, such as dorsiflexion, eversion, inversion, internal rotation, external rotation, or another position, the user 1) selects offset member 210 with the desired offset angle; 2) removably couples the selected offset member 210 to second segment 122 using a coupling means, such as a clevis pin or the like; 3) selects attachment point 206 wherein the selected attachment point 206 is positioned on shoe sleeve 202 to bias shoe 101 into the desired position; and 4) removably couples biasing member 211 to the selected attachment point 206. As discussed herein, a plurality of biasing member 211-offset member 210 combinations are coupled to points along second segment 122 and a plurality of attachment points 206 in a configuration to 1) increase the force biasing shoe 201 toward a single selected position; or 2) add a force biasing shoe 201 toward a second selected position. For example, it may be necessary or desirable to bias the user's foot simultaneously toward both dorsiflexion and eversion.

The components defining any locomotor training system and device may be formed of any of many different types of materials or combinations thereof that can readily be formed into shaped objects provided that the components selected are consistent with the intended operation of a locomotor training system and device. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials;

metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any locomotor training system and device may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, annealing, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Figure 9A:
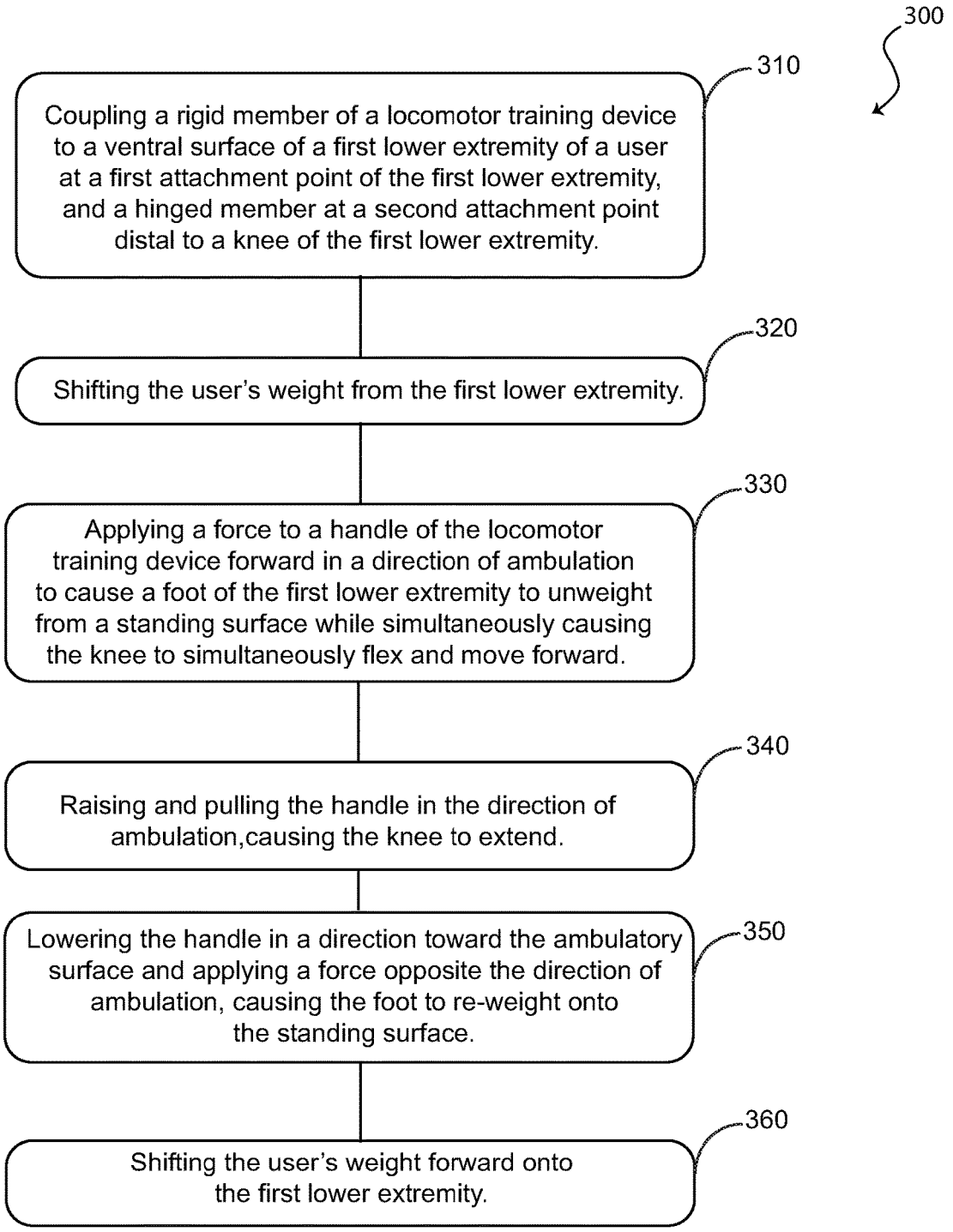
FIGS. 9*a-b* are a flowchart diagrams of a method of use of a locomotor training device.
Figure 9B:
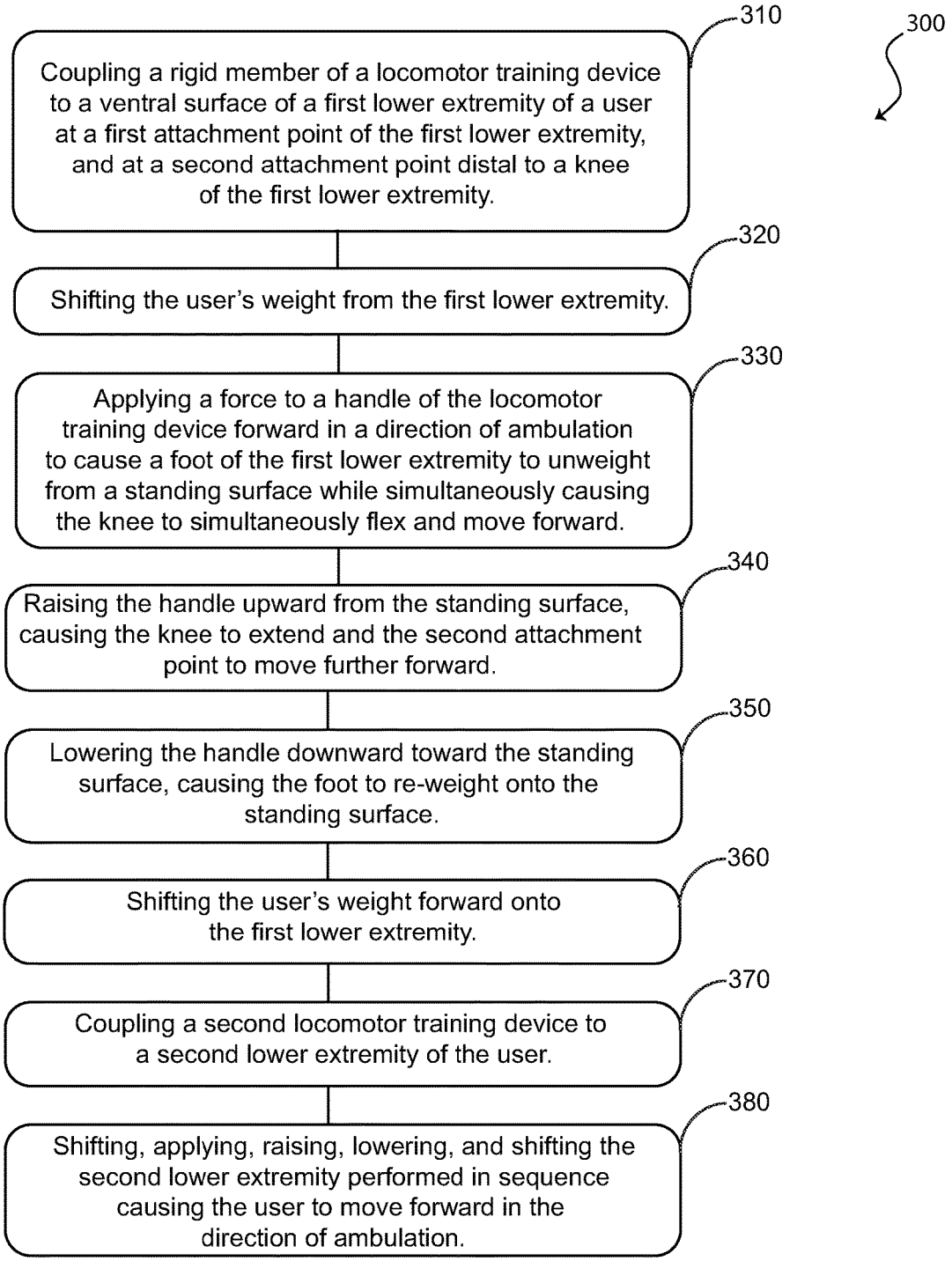

FIGS. 9*a-b* are flowchart diagrams of a method of use of a locomotor training device. FIG. 9*a* shows a method 300 of use of a locomotor training device comprising a coupling step 310, a shifting step 320, an applying step 330, a raising step 340, a lowering step 350, and a shifting step 360. FIG. 9*b* shows additional embodiments of method 300 comprising a second coupling step 370 and second shifting, applying, raising, lowering, and shifting steps 380. The various steps and embodiments of method 300 are also discussed with reference to FIGS. 10*a-d*, which are diagrams showing use of a locomotor training device.

The locomotor training device is used by an operator 170 to assist a user 171 to ambulate along an ambulation surface 250. As shown by FIG. 9*a*, coupling step 310 of method 300 comprises coupling a rigid member of a locomotor training device to a ventral surface of a first lower extremity of a user at a first attachment point of the first lower extremity, and at a second attachment point distal to a knee of the first lower extremity, in some embodiments. Coupling is accomplished by placing a rigid plate of a first ventral leg attachment against a ventral surface of a lower extremity of user 171. In most cases, the point of ventral attachment is proximal to the knee on the lower extremity, although in some users, the first point of ventral attachment is distal to the knee. In some embodiments, a positioning strap is temporarily encircled around the lower extremity to hold the first ventral leg attachment onto the lower extremity, facilitating placement of a first strap. The first strap may comprise one strap, two straps, or a plurality of straps coupled to one another, and which all encircle the lower extremity. In some embodiments, the first strap(s) are passed through a loop, such as a surface feature unitary with the first ventral leg attachment, a D-ring, or the like, and then doubled-back and reversibly fastened to itself using a hook-and-loop closure, a clip, snap or related fastener, or the like. Any suitable attachment means for reversibly coupling the first ventral leg attachment to a ventral surface of user 171's lower extremity is used. The attachment means is adjusted into the desired position and tension. Coupling of the second attachment point on the ventral aspect of the lower extremity distal to the knee is performed in a manner similar to that coupling the first ventral attachment point, in some embodiments. Although it is generally useful to couple the rigid member before coupling the hinged member, in some embodiments, the order of attachment is not important. Coupling step 310 is completed, in some embodiments wherein user 171 is seated, by user 171 moving into a standing position, with assistance, as needed. Operator 170 assists user 171, in some embodiments, with standing by applying a force to the locomotor training device downward and in a direction opposite the direction of ambulation, to assist in keeping the knee extended as a portion of the user 171's weight transitions onto the user's knee.

Once the locomotor training device is coupled to the lower extremity of user 171, the operator 170 grasps and lifts a handle disposed at an operator end of the rigid member of the locomotor training device, as shown in FIG. 10-*a*. FIG. 10*a* also shows a first angle 106, a second angle 107, and a third angle 108. First angle 106 is formed between the ventral surface of the lower extremity of user 171 and the rigid member of the locomotor training device. Second angle 107 is formed between the rigid member and a first segment of the hinged member. Third angle 108 is formed between the first segment and a second segment of the hinged member. First angle 105, second angle 107, and third angle 108 remain dynamic during use of the locomotor training device employed by method 300 and change throughout the several steps of method 300, as described herein below.

Figure 10A:
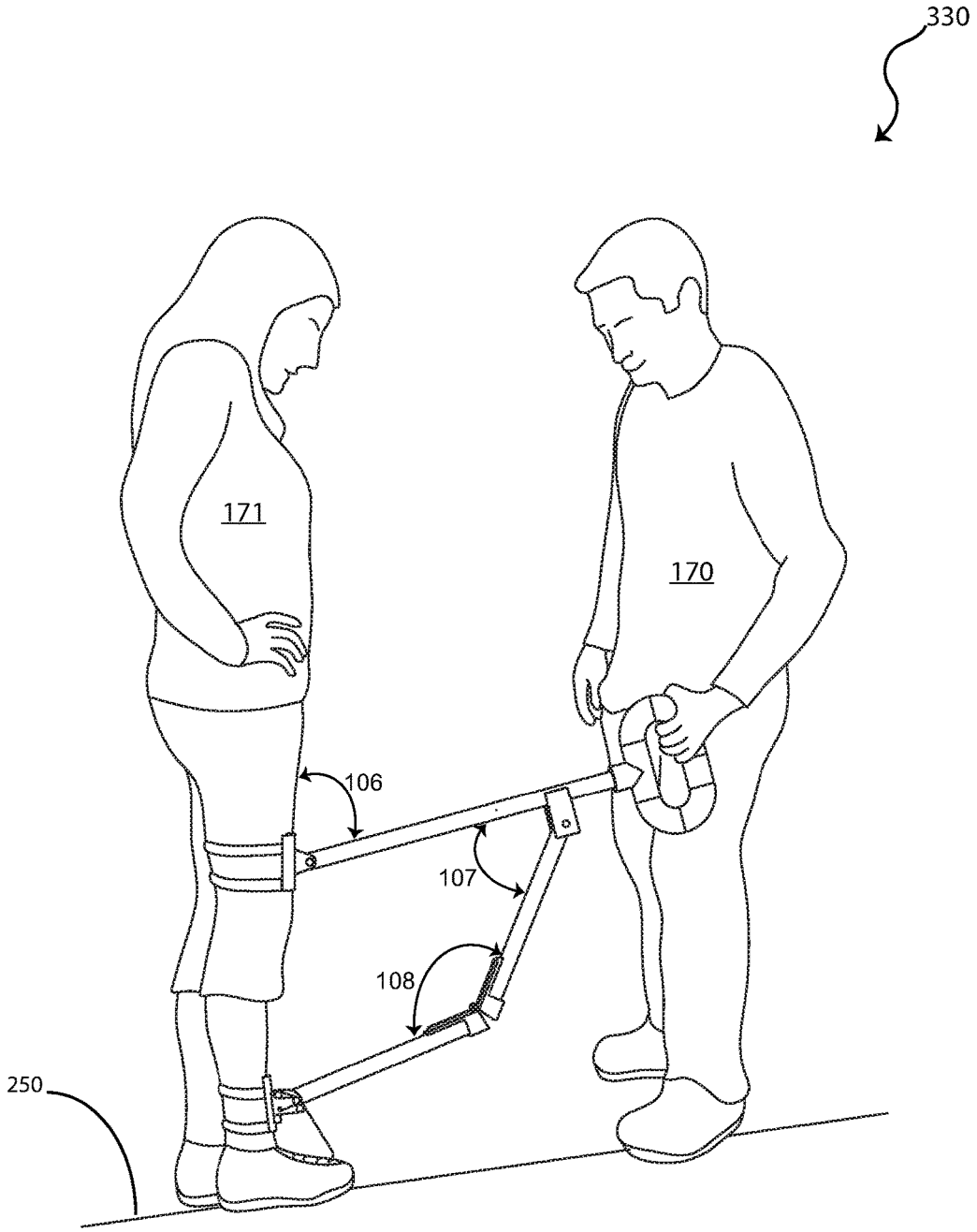
FIG. 10*a-d* are diagrams showing use of a locomotor training device.

Shifting step 320, in some embodiments, comprises shifting the user's weight from the first lower extremity. In preparation for forward ambulation along surface 250, as shown in FIG. 10*a*, user 171 shifts her weight off of the lower extremity coupled to the locomotor training device and onto the contralateral lower extremity. This off-weighting of the lower extremity allows operator 170 to assist with moving the lower extremity by applying forces to the locomotor training device, which operator 170 grasps by a handle, wherein operator 170 executes by performing a series of arm movements, as described below. "Applying a force," as disclosed in describing subsequent steps of method 300, means forces generated by operator 170 grasping the handle of the locomotor training device.

Applying step 330, in some embodiments, comprises applying a force to a handle of the locomotor training device forward in a direction of ambulation to cause a foot of the first lower extremity to unweight from a ambulatory surface while simultaneously causing the knee to flex and move forward. In performing applying step 330, operator 170 pulls the handle to unlock the knee of user 171, wherein the knee flexes and moves forward.

Figure 10B:
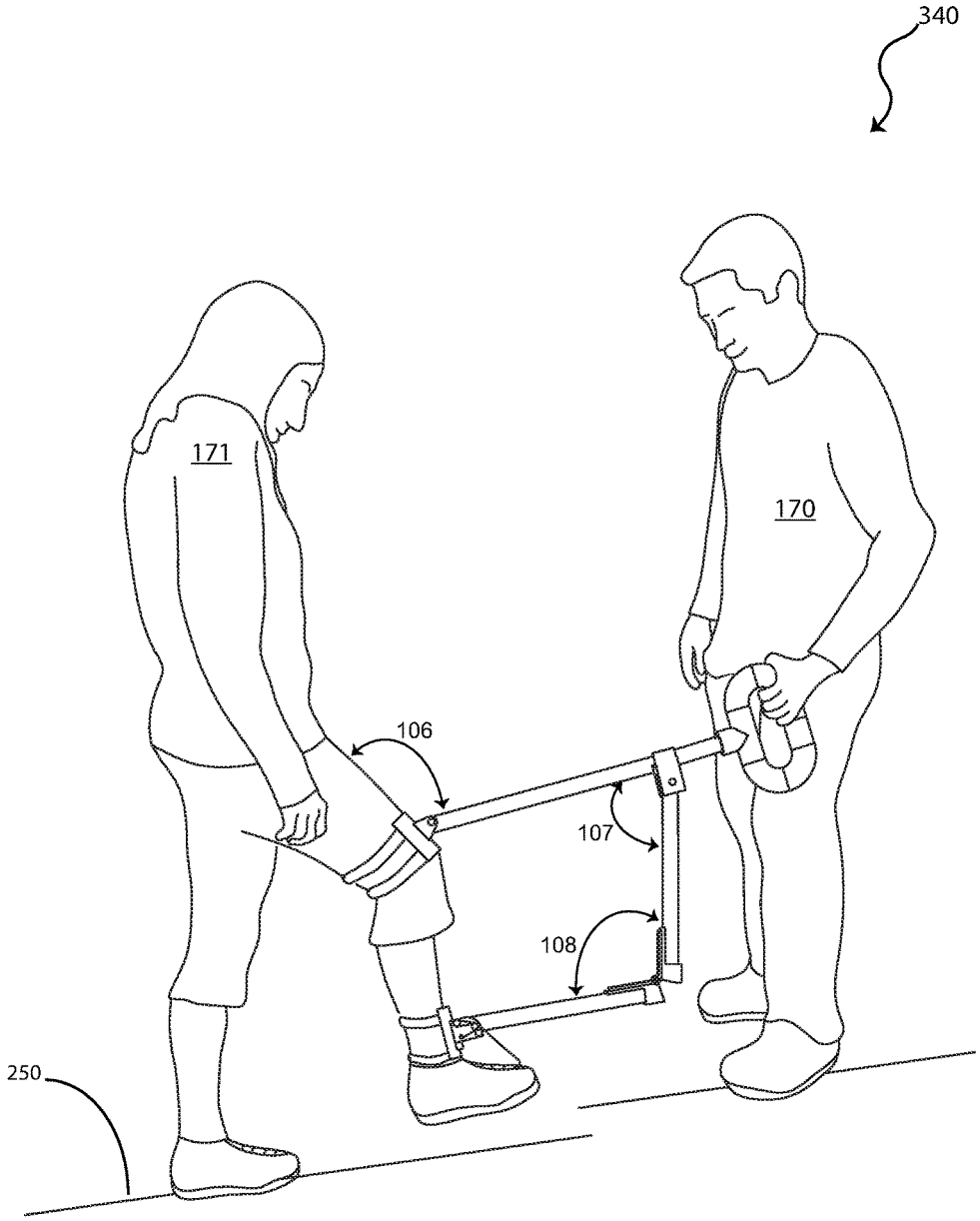

Raising step 340, in some embodiments, comprises raising the handle upward from the ambulatory surface, causing the knee to extend and the second attachment point to move further forward. Raising step 340 is shown by FIG. 10*b*. User 170 pulls and raises the handle of locomotor training device. In some embodiments, raising step 340 includes raising the handle to bring second joint 123 into its fully extended position, wherein user 171's foot is pulled through and extension at the knee is caused or assisted. This motion is transmitted to the lower extremity, wherein the knee of user 171 is raised and moved forward, increasing first angle 106. Simultaneously, lifting the handle increases second angle 107 and decreases third angle 108, extending the knee joint of the lower extremity while raising and moving the user's foot forward in the direction of ambulation.

As can be appreciated, the rigid member of the locomotor training device allows operator 170 to move the user's knee into a desired position while providing support and stabilization of the proximal portion of the lower extremity. Additionally, the flexible member allows user 171 to activate knee extensors, to the extent allowed by user 171's functional capacity, without restriction or undue impairment from operator 170. Moreover, to the extent that user 171 lacks functional neuromuscular capacity to extend her knee, operator 170 causes knee extension through the complementary action of the first ventral leg attachment proximally and the leg attachment distally through the locomotor training device during raising step 340, in some embodiments.

Figure 10C:
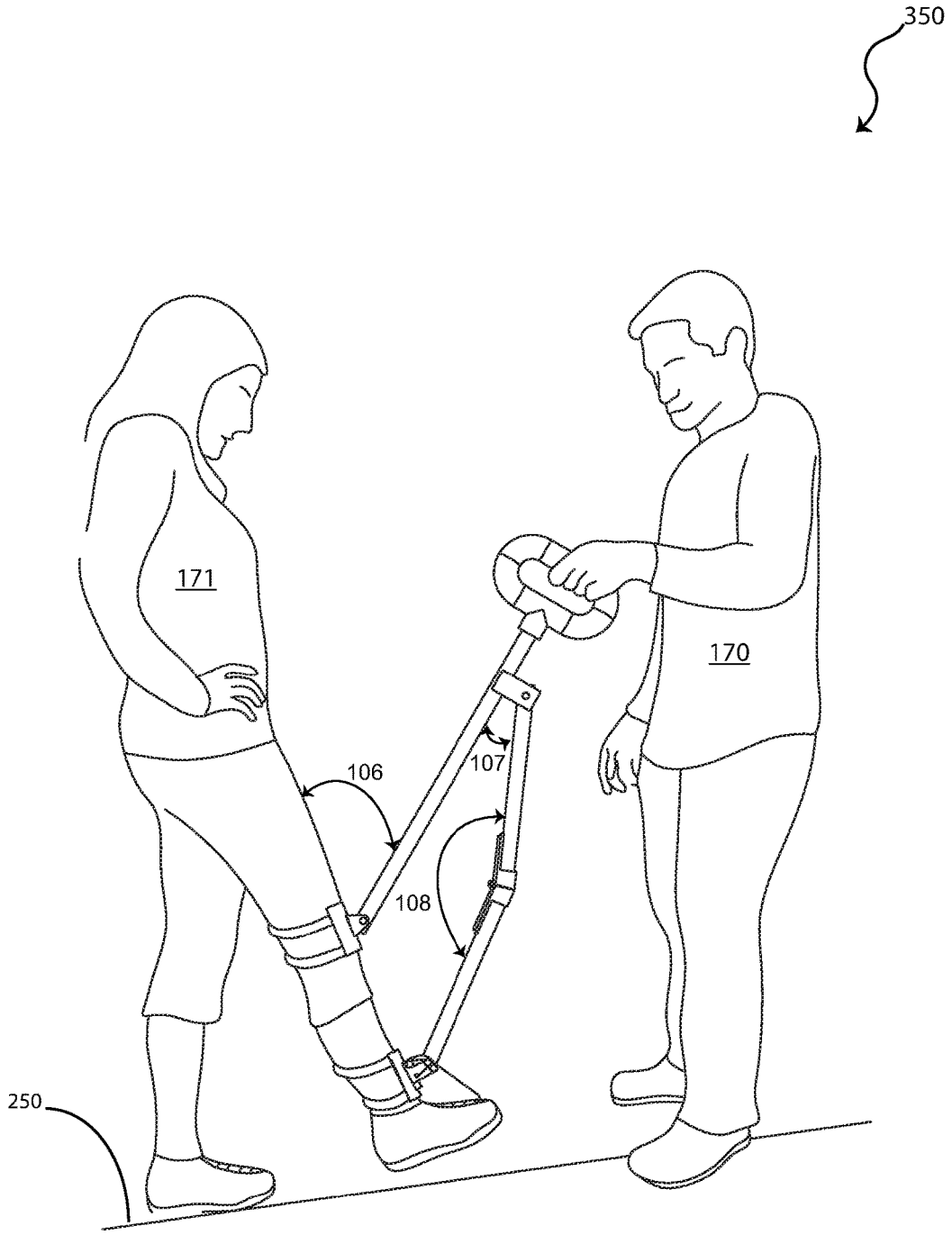
Figure 10D:
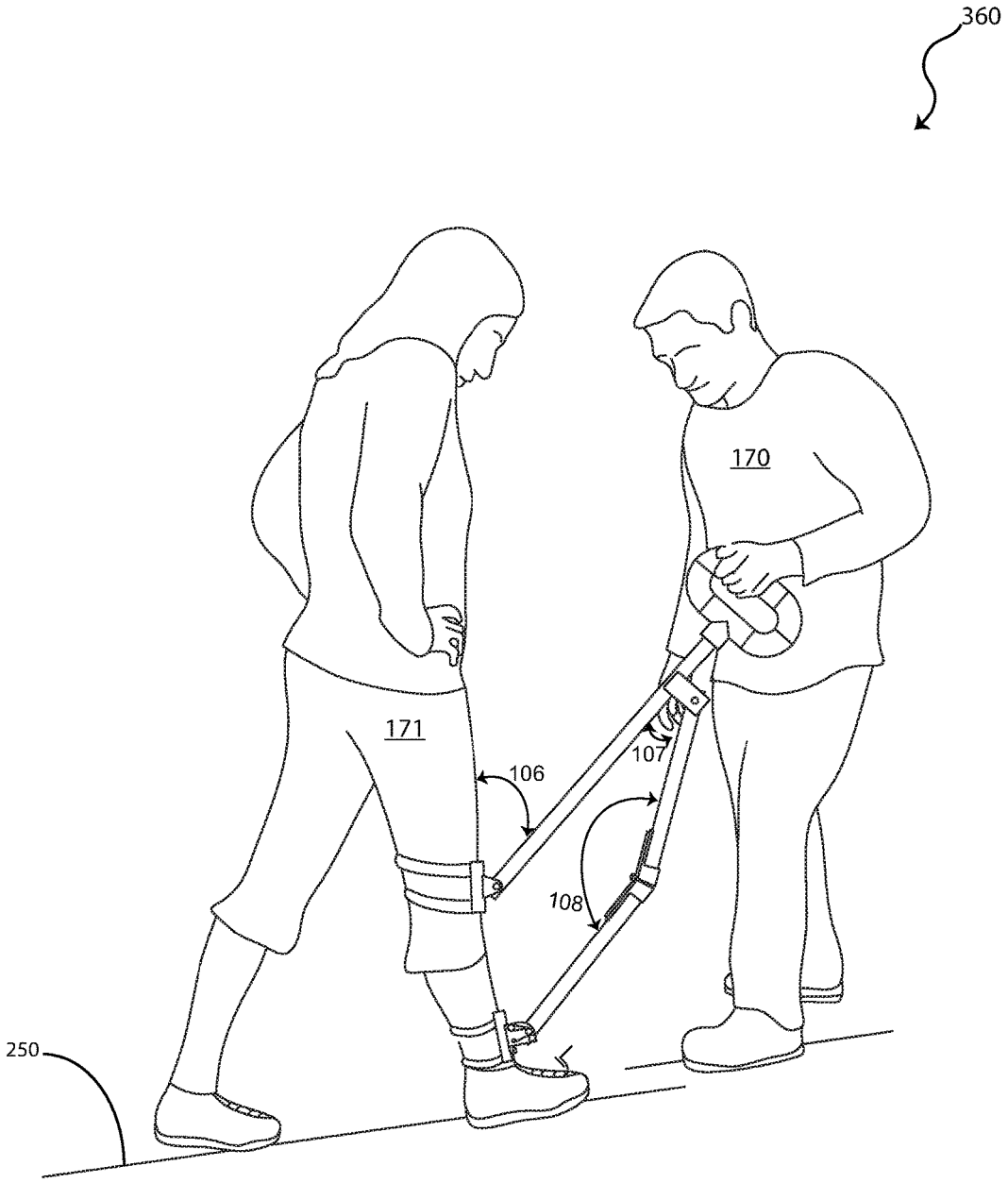

Lowering step 350, in some embodiments, comprises lowering the handle downward toward the ambulatory surface and applying a force opposite the direction of ambulation, causing the foot to re-weight onto the ambulatory surface. Lowering step 350 is illustrated by FIG. 10*c* and FIG. 10*d*. Similar to raising step 340, user 170 manipulates the locomotor training device to stabilize the lower extremity proximally through the rigid member while changing the degree of knee extension through the hinged member. As shown by FIG. 10*c*, rotating the rigid member toward user 171 causes first angle 106 to decrease while simultaneously decreasing second angle 107 and increasing third angle 108, causing extension of the knee of user 171. In some embodiments, lowering step 350 employs a locomotor training device with an angle-stop at a hinge joint between the first segment and the second segment of the hinged member, wherein the maximum size to which third angle 108 may be extended is about one hundred seventy degrees (170°). Depending on the length of the rigid member and the anthropometrics of user 171's lower extremity, limitation of the maximum opening of third angle 108 by the angle stop reduces the risk of inadvertent hyperextension of the knee of user 171.

Shifting step 360, in some embodiments, comprises shifting the user's weight forward onto the first lower extremity. Shifting step 360 is illustrated in FIG. 10*d*. During shifting step 360, user 171 on-weights her lower extremity, which remains supported by operator 170 of the locomotor training device. User 171 additionally shifts her weight forward in the direction of ambulation, as suggested by FIG. 10*d*. In some embodiments, user 170 pushes the handle in a direction opposite the direction of ambulation to assist user 171 keep the advanced knee extended while user 171 shifts her weight forward onto the advanced knee. Although not shown in the drawing figures, in some embodiments wherein user 171 is capable of independent use of her contralateral lower extremity, user 171 steps forward with the contralateral lower extremity to complete shifting step 360.

Steps 310, 320, 330, 340, 350, and 360 of method 300 are then repeated, resulting in user 171 ambulating in a forward direction along surface 250, while receiving assistance and training from operator 170 employing the locomotor training device.

As shown by FIG. 9*b*, coupling step 370, in some embodiments, comprises coupling a second locomotor training device to a second lower extremity of the user. Many users of the locomotor training device will have limited neuromuscular capabilities in both lower extremities and, therefore, benefit from the simultaneous use of two locomotor training devices, one coupled to each lower extremity. Coupling step 370 is performed as described herein above under coupling step 310.

Shifting step 380, in some embodiments, comprises shifting, applying, raising, lowering, and shifting the second lower extremity performed in sequence causing the user to move forward in the direction of ambulation. Following performance of second coupling step 370, shifting step 380 is performed following and alternating with steps 310-360. In this manner, operator 170 assists, supports, and trains user 171 in forward ambulation using dual locomotor training devices in concert. The shifting, applying, raising, lowering, and shifting sub-steps of shifting step 380 are performed in relation to the contralateral lower extremity coupled to the second locomotor training device, as described herein above, in some embodiments.

A locomotor training system and device, including methods of use, has been described. The locomotor training system and device overcomes problems with the prior art by allowing a person with incomplete or complete paralysis or limited neuromuscular impairment to ambulate across a surface fully using existing neuromuscular lower extremity function, with any decreased of absence of function supplanted by the operator's force inputs. Ambulation training and assistance is delivered by an operator-assistant using a mechanically simple, small, and non-bulky device to receive assistance re-creating weight bearing and optimal joint mechanics similar to fully independent, unimpaired ambulation. The disclosed locomotor training device and method of use enables ambulation training and assistance allowing the user, with necessary but minimal external bracing, to support her body weight while re-creating normal joint mechanics for forward ambulation. Use of the ambulation assist and training device promotes neuromuscular re-education and strength increases of muscles necessary for ambulation in a spinal cord injury patient.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A locomotor training device comprising:

a rigid bracing member having a first user end coupled to a first ventral leg attachment and an operator end coupled to a handle;

a hinged bracing member coupled to the rigid bracing member at a first joint near the operator end, having a first segment coupled to the first joint, a second segment rotatably coupled to the first segment opposite a second user end; and a second ventral leg attachment coupled to the second user end.

2. The locomotor training device of claim 1, wherein the first joint comprises an adjustable couple that slideably engages the rigid bracing member and is rotatably coupled to the first segment, having a slide locking means configured to reversibly lock the adjustable couple in a position along a continuum of positions relative to the operator end of the rigid bracing member.

3. The locomotor training device of claim 1, further comprising a foot position biasing system having:

a shoe sleeve configured to removably attach to a shoe;

an offset member coupled to the second segment; and a biasing member coupled between the shoe sleeve and the offset member;

wherein the offset member is configured to position the biasing member to bias the shoe worn by a user into an ambulatory position.

4. The locomotor training device of claim 3, wherein the biasing member reversibly couples to the shoe sleeve at an attachment point selected from a plurality of attachment points.

5. The locomotor training device of claim 3, comprising a number of offset members and a corresponding number of biasing members.

6. The locomotor training device of claim 3, wherein the ambulatory position is either eversion or inversion.

7. The locomotor training device of claim 3, wherein the ambulatory position is either internal rotation or external rotation.

8. The locomotor training device of claim 3, wherein the shoe is biased into a plurality of ambulatory positions.

9. A locomotor training device comprising:

a rigid bracing member having a first user end and an operator end, wherein the rigid bracing member is configured to form a first angle with a ventral surface of a lower extremity of a user when the first user end is pivotally coupled to the lower extremity; and a hinged bracing member coupled to the rigid bracing member at a first joint located near the operator end, having a first segment pivotally coupled to the first joint, a second segment pivotally coupled to the first segment at a second joint and having a second user end;

wherein under a condition of the first user end pivotally coupled to the ventral surface of the lower extremity and the second user end pivotally coupled to the ventral surface of lower extremity distal to the first user end, pivoting the first user end at the lower extremity to decrease the first angle causes the hinge to open; and pivoting the first user end at the lower extremity to increase the first angle causes the hinge to close.

10. The locomotor training device of claim 9, wherein the first joint is configured to form a second angle between the rigid bracing member and the first segment within a range of about 30° to about 150°.

11. The locomotor training device of claim 9, wherein the hinged member is configured to form a third angle between the first segment and the second segment within a range of about 45° to about 170°.

12. The locomotor training device of claim 9, further comprising a first ventral leg attachment coupled to the user end, wherein the first ventral leg attachment is configured to pivotally couple the first user end to the lower extremity.

13. The locomotor training device of claim 9, wherein the first user end is configured to couple to the lower extremity at a position proximal to a knee of the user.

14. The locomotor training device of claim 9, wherein the first user end is configured to couple to the lower extremity at a position distal to a knee of the user.

15. The locomotor training device of claim 9, further comprising a second leg attachment coupled to the second user end of the second segment, wherein the second leg attachment is configured to pivotally couple the second user end to the lower extremity distal to the knee of the user.

16. The locomotor training device of claim 15, wherein the second leg attachment comprises:

a ventral contacting member;

a positioning strap removably coupled to the ventral contacting member;

a friction pad coupled to the ventral contacting member; and an adjustable coupling member removably coupled to the ventral contacting member.

17. The locomotor training device of claim 9, further comprising a first leg attachment coupled to the first user end of the rigid member, wherein the first leg attachment is configured to pivotally couple the first user end to the lower extremity proximal to the second leg attachment.

18. A method of ambulation training comprising steps:

coupling a rigid member of a locomotor training device to a ventral surface of a first lower extremity of a user at a first attachment point of the first lower extremity, and a hinged member at a second attachment point distal to a knee of the first lower extremity;

shifting the user's weight from the first lower extremity;

applying a force to a handle of the locomotor training device forward in a direction of ambulation to cause a foot of the first lower extremity to unweight from a ambulatory surface while simultaneously causing the knee to simultaneously flex and move forward;

pulling the handle in a direction of ambulation, causing the knee to extend and the second attachment point to move further forward;

lowering the handle downward toward the ambulatory surface, causing the foot to re-weight onto the ambulatory surface; and shifting the user's weight forward onto the first lower extremity.

19. The method of claim 18, further comprising a second coupling step wherein a second locomotor training device is coupled to a second lower extremity of the user; and an additional shifting step, an additional applying step, an additional raising step, an additional lowering step, and an additional shifting step applied to the second lower extremity performed in sequence following the steps of claim 9, causing the user to move forward in the direction of ambulation.

20. The method of claim 18, further comprising a biasing step, wherein a foot position biasing system coupled to the locomotor training device biases the foot into an ambulatory position.

* * * * *